US007711296B2

(12) United States Patent
Gross et al.

(10) Patent No.: US 7,711,296 B2
(45) Date of Patent: May 4, 2010

(54) PRETRANSFER TONER TREATMENT IN AN ELECTROSTATOGRAPHIC PRINTER

(75) Inventors: Robert Arnold Gross, Penfield, NY (US); David Keneth Ahl, Rochester, NY (US); Michael Nicholas Soures, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 917 days.

(21) Appl. No.: 11/512,484

(22) Filed: Aug. 30, 2006

(65) Prior Publication Data

US 2008/0056776 A1 Mar. 6, 2008

(51) Int. Cl.
*G03G 15/16* (2006.01)

(52) U.S. Cl. ..... 399/296; 399/66; 399/237; 399/231

(58) Field of Classification Search ..... 399/311, 399/296, 316

See application file for complete search history.

(56) References Cited

U.S. PATENT DOCUMENTS 4,039,257 A 8/1977 Connolly
4,077,709 A 3/1978 Borostyan et al.
6,233,413 B1 * 5/2001 Folkins ..... 399/71
6,456,394 B1 9/2002 Gwaltney et al.
6,845,224 B1 1/2005 Gross et al.
7,013,105 B2 3/2006 Omata
2003/0108369 A1 * 6/2003 Kuo et al. ..... 399/310

* cited by examiner

*Primary Examiner*—David M Gray
*Assistant Examiner*—Roy Yi
(74) *Attorney, Agent, or Firm*—Maginot, Moore & Beck LLP

(57) ABSTRACT

A system for reducing lead edge (LE) smearing in an electrostatographic machine is provided. The system comprises a pretransfer corotron positioned between a developing station and a transfer station in an electrostatographic imaging device. The pretransfer corotron is configured to apply a predetermined charge to at least a portion of a developed toner image on a photoreceptive surface. The predetermined charge is greater than a charge applied to the rest of the developed toner image. The system further includes a controller operably associated with the pretransfer corotron. The controller is configured to activate the pretransfer corotron to apply said predetermined charge to the developed toner image at a lead edge region of the developed toner image when leading edge smearing is detected during imaging operations.

20 Claims, 3 Drawing Sheets

PRETRANSFER TONER TREATMENT IN AN ELECTROSTATOGRAPHIC PRINTER

TECHNICAL FIELD

The present disclosure relates generally to transfer efficiency in an electrostatographic imaging device, and, in particular, to leading edge smearing during transfer in an electrostatographic imaging device.

BACKGROUND

In high-speed reproduction machines, such as electrostatographic copiers and printers, a photoconductive member (or photoreceptor) is charged to a uniform potential and then a light image of an original document is exposed onto a photoconductive surface, either directly or via a digital image driven laser. Exposing the charged photoreceptor to a light image discharges the photoconductive surface thereof in areas corresponding to non-image areas in the original document while maintaining the charge on the image areas to create an electrostatic latent image of the original document on the photoconductive surface of the photoreceptor. A developer material is then brought into contact with the surface of the photoconductive member to transform the latent image into a visible reproduction. The developer material includes toner particles with an electrical polarity opposite that of the photoconductive member, causing them to be naturally drawn to it. A blank print substrate such as a sheet of paper is brought into contact with the photoconductive member and the toner materials are transferred to it by electrostatic charging of the substrate. The substrate is subsequently heated and pressed to permanently bond the reproduced image to the substrate, thus producing a hard print reproduction of the original document or image. Thereafter, the photoconductive member is cleaned and reused for subsequent print production.

The process of transferring charged toner particles from an image bearing member, such as the photoreceptive member, to an image support substrate, such as a print sheet, is accomp lished at a transfer station. In a conventional electrostatographic machine, transfer is achieved by transporting an image support substrate into the area of the transfer station where electrostatic force fields sufficient to overcome the forces holding the toner particles to the photoconductive surface are applied to the substrate to attract and transfer the toner particles to the image support substrate. In general, such electrostatic force fields are generated via electrostatic induction using a corona generating device. The reverse side of the print sheet is exposed to a corona discharge while the front of the print sheet is placed in direct contact with the developed toner image on the photoconductive surface. The corona discharge generates ions having a polarity opposite that of the toner particles, thereby electrostatically attracting and transferring the toner particles from the photoreceptive image bearing member to the print sheet.

The interface between the image bearing surface and the print sheet, however, is not always optimal. In particular, non-flat or uneven image support substrates, such as copy sheets that have been mishandled, paper that has been left exposed to the environment, or substrates that have previously passed through a fixing operation (for example, heat and/or pressure fusing) often tend to yield imperfect contact with the photoconductive surface. Some printing applications require imaging onto high quality papers having surface textures which prevent intimate contact of the paper with the developed toner images. In duplex printing systems, even initially flat paper can become cockled or wrinkled as a result of paper transport and/or the first side fusing step. Also, color images can contain areas in which intimate contact of toner with paper during the transfer step is prevented due to adjacent areas of high toner pile heights. The lack of uniform intimate contact between the belt and the copy sheet in these situations can result in spaces or air gaps between the developed toner powder image on the selectively charged imaging surface and the copy substrate. When spaces or gaps exist between the developed image and the copy substrate, various problems may result. For example, there is a tendency for toner not to transfer across gaps, causing variable transfer efficiency and, under extreme circumstances, creating areas of low toner transfer or even no transfer, resulting in a phenomenon known as image transfer deletion.

In order to minimize transfer deletions, transfer assist blades (TABs) have been utilized to press the back of the copy substrate against the imaged area of the charged imaging surface. The transfer assist blade is typically moved from a non-operative position spaced from the copy substrate, to an operative position in contact with the copy substrate. A mechanism supporting the TAB is operable to press the TAB against the copy sheet with a typically pre-determined force sufficient to press the copy substrate into contact with the developed image on the photoconductive or other charged imaging surface in order to substantially eliminate any spaces therebetween during the transfer process.

While the transfer assist apparatus of the type described above may be used to improve transfer efficiency, it may also induce copy quality defects in the lead edge area of the copy sheet. For instance, when the developed toner image extends to the lead edge of the imaged area on the photoreceptor, there may be a loss of toner electrostatic tack force in the lead edge region. As a result, drag force on the image substrate caused by pressing the TAB onto the substrate may be greater than the tack force between the substrate and the photoreceptor, which, in turn, generates a velocity mismatch between the copy sheet and the photoreceptor, manifesting itself as a smeared image on the lead edge of the copy sheet. This lead edge image defect is unacceptable in most high speed environments where customers demand lead edge to trail edge copy quality as the electrostatographic printing process penetrates further into the offset printing market.

One method that has been utilized to minimize the leading edge smear defect is delaying the engagement of the TAB to allow the electrostatic tacking force to increase by providing a timing delay between sensing of the leading or trailing edge of a copy substrate and actuation of the mechanism that urges the TAB toward the copy substrate. Delaying engagement of the TAB, however, may result in spaces or air gaps between the developed toner powder image on the selectively charged imaging surface at the lead edge resulting in transfer deletions at the lead edge.

SUMMARY

A system for reducing lead edge (LE) smearing in an electrostatographic machine is provided. The system comprises a pretransfer corotron positioned between a developing station and a transfer station in an electrostatographic imaging device. The pretransfer corotron is configured to apply a predetermined charge to at least a portion of a developed toner image on a photoreceptive surface. The predetermined charge is for increasing an electrostatic tacking force that tacks the toner of the developed toner image to the photoreceptive surface. The system further includes a controller operably associated with the pretransfer corotron. The controller is configured to activate the pretransfer corotron to apply said predetermined charge to the developed toner image at a lead edge region of the developed toner image when leading edge smearing is detected during imaging operations.

In another embodiment, a method for reducing LE smear in an electrostatographic imaging device is provided. The method comprises detecting if LE smear is indicated during imaging operations. If LE smear is indicated, tacking force for tacking toner of a developed toner image to a photoreceptive member is increased at approximately the lead edge region of the developed toner image on the photoreceptive surface prior to transfer. Increasing the tacking force may comprise applying a charge to the lead edge region of developed toner image using a pretransfer corotron.

In yet another embodiment, an electrostatographic machine operable to reduce LE smearing is provided. The electrostatographic machine comprises a circulating photoreceptive member; a charging station for uniformly charging the photoreceptive member; an imaging station for selectively discharging the photoreceptive member to form latent images thereon; a developing station for depositing toner on the latent images; a transfer station for transferring the developed toner image from the photoreceptive member to an image substrate; a pretransfer corotron for applying a predetermined charge to a lead edge region of the developed toner image prior to transfer, the predetermined charge for tacking toner of the lead region of the developed toner image to the photoreceptive member; and a system controller operably associated with the pretransfer corotron, the system controller for activating the pretransfer corotron to apply the predetermined charge to the lead edge region of the developed toner image when lead edge smearing is detected during imaging operations.

BRIEF DESCRIPTION OF THE DRAWINGS

Aspects and features of the present embodiments will become apparent as the following description proceeds and upon reference to the drawings, in which.

DESCRIPTION

Figure 1:
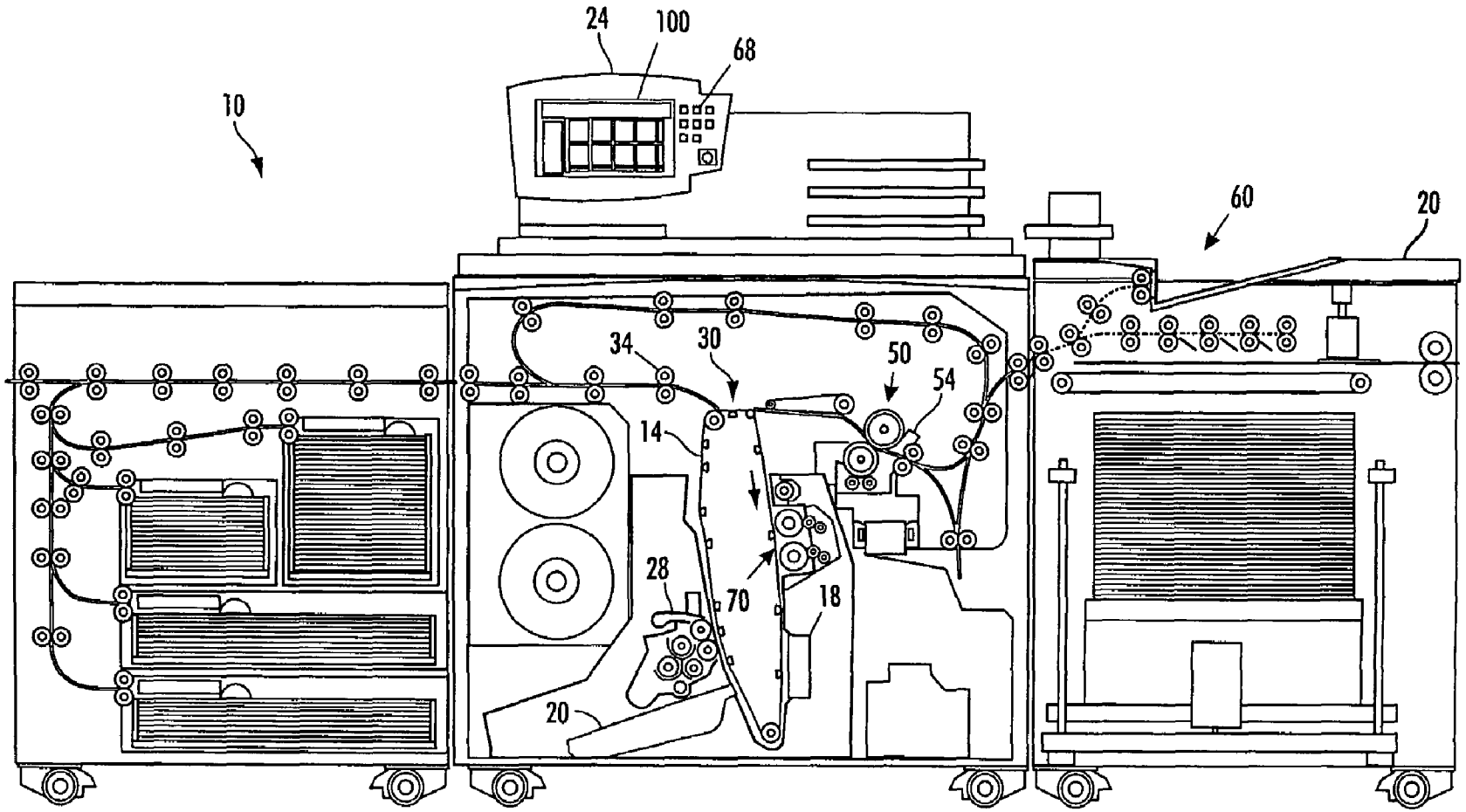
FIG. 1 is a schematic elevational view of an illustrative electrostatographic machine.

For a general understanding of the present embodiments, reference is made to the drawings. In the drawings, like reference numerals have been used throughout to designate like elements.

An exemplary imaging system is a multifunctional printer with print, copy, scan, and fax services. Such multifunctional printers are well known in the art and may comprise print engines based upon liquid or solid ink jet, electrophotography, other electrostatographic technologies, and other imaging technologies. The general principles of electrophotographic imaging are well known to many skilled in the art and are described above as an exemplary embodiment of an imaging system to which the present disclosure is applicable.

Moving now to a description of FIG. 1, there is shown an elevational view of an electrostatographic printing apparatus 10, such as a printer or copier, including a feeder unit 14, an imaging unit 18, and an output unit 20. The feeder unit 14 houses supplies of media sheets and substrates onto which document images are transferred by the printing unit 18. Sheets to which images have been fixed are delivered to the output unit 20 for correlating and/or stacking in trays for pickup.

The imaging unit 18 employs an image-retentive member, such as photoreceptor belt 14. The belt 14 includes a photoconductive surface deposited on an electrically grounded conductive substrate. Photoreceptor 14 continuously travels the circuit depicted in the figure in the direction indicated by the arrow advancing successive portions of the photoconductive surface of the belt 14 through various processing stations, disposed about the path of movement thereof, as will be described. While a photoreceptor belt 14 is shown, other types of image-retentive members may be used, such as an intermediate belt or drum as used in a color electrophotographic machine, offset printing apparatus, or ink-jet printer.

Initially, a segment of belt 14 passes through charging station 18. At charging station 18, a corona generating device (not shown) or other charging apparatus, charges photoreceptor belt 14 to a relatively high, substantially uniform potential which is typically a negative voltage between −600V and −800V. Once charged, the photoreceptor belt 14 is advanced to imaging station 20.

At imaging station 20, a raster output scanner (ROS) (not shown) discharges selectively those portions of the charge corresponding to the image portions of the document to be reproduced. In this way, an electrostatic latent image is recorded on the photoconductive surface. An electronic subsystem (ESS) (not shown) controls the ROS. The ESS is adapted to receive signals from a system controller 100 and transpose these signals into suitable signals for controlling the ROS so as to record an electrostatic latent image corresponding to the document to be reproduced by the printing machine 10. Other types of imaging systems may also be used employing, for example, a pivoting or shiftable LED write bar or projection LCD (liquid crystal display) or other electro-optic display as the "write" source. When exposed at the imaging station 20, the photoreceptor surface is selectively discharged to a level of about −60V to −80V.

After the electrostatic latent image is recorded on photoconductive surface of belt 14, belt 14 advances to development station 28 where toner material is deposited onto the electrostatic latent image. In the development station 28, toner particles are mixed with carrier beads, generating an electrostatic charge therebetween which causes the toner particles to cling to the carrier beads to form developing material. The developing material is brought into contact with the photoreceptor belt 14 such that the latent image thereon attracts the toner particles from the developing material to develop the latent image into a visible image.

Subsequent to image development, a substrate (not shown) is moved into contact with toner images at transfer station 30. The substrate is obtained from a supply and advanced to transfer station 30 by sheet feeding unit 14. The substrate is then brought into contact with the photoconductive surface of photoreceptor belt 14 in a timed sequence so that the toner powder image developed thereon contacts the advancing substrate at transfer station 30. Transfer station 30 preferably includes a corona-generating device, such as a corotron, for charging the copy sheet to a proper potential so that the sheet is electrostatically secured or "tacked" to belt 10 and the toner image thereon is attracted to the copy sheet. As previously discussed, it is not uncommon for air gaps or spaces to exist between the copy sheet and the surface of the belt 14 at the transfer station. Thus, the interface between the sheet feeding apparatus and transfer station 30 may include a transfer assist apparatus, such as transfer assist blade 20 for applying uniform contact pressure to the sheet as it is advanced onto belt 14.

After transfer, the substrate continues to advance toward fuser station 50. The toner image is thereby forced into contact with the substrate 68 between fuser rollers 54 and 58 to permanently affix the toner image to substrate 68. After fusing, the print substrate 68 is advanced to receiving tray 60 for subsequent removal by an operator.

After the substrate is separated from photoconductive surface of photoreceptor belt 14, the residual toner particles carried by the non-image areas on the photoconductive surface are removed therefrom. These particles are removed at cleaning station 70, using, for example, a cleaning brush or plural brush structure or any number of well known cleaning systems.

The various machine functions are regulated by a system controller 100 contained within control panel 24. The controller 100 is preferably a programmable controller, such as a microprocessor, which controls all of the machine functions hereinbefore described. The controller may be programmed to monitor various operating parameters of the electrostatographic machine such as print substrate type, the number of documents being recirculated, the number of print sheets selected by the operator, time delays, and jam indications, among other various functions including transfer assist actuation. Conventional sheet path sensors or switches may be utilized to keep track of the types and position of documents and print substrates in the machine. The system controller may include a pixel counter (see FIG. 2) for counting the number of pixels to be imaged with toner on each sheet or page of the job, for each color. The pixel count information is stored in a memory of the system controller 100. A memory may be provided to store data necessary for the controller such as, for example, the various component control protocols. The memory may be a non-volatile memory such as a read only memory (ROM) or a programmable non-volatile memory such as an EEPROM or flash memory. Of course, memory 90 may be incorporated into the controller 100, or may be externally located.

The operation of all of the exemplary systems described hereinabove may be accomplished by conventional user interface control. The user interface 68 is configured to display the available features and programming options, such as media trays, the type of media in each tray, the size of media in the trays, colors of ink or toner, and the like, and may be used to obtain the print job parameters for a print job so the MFD driver is able to generate the print job and send it to the MFD for processing.

The foregoing description should be sufficient for purposes of illustrating the general operation of an electrostatographic printing machine incorporating an exemplary embodiment of an apparatus for reducing transfer deletions. As described, an electrostatographic printing machine may take the form of any of several well known devices or systems. Variations of specific electrostatographic processing subsystems or processes may be expected without affecting the operation of the exemplary embodiment.

Figure 2:
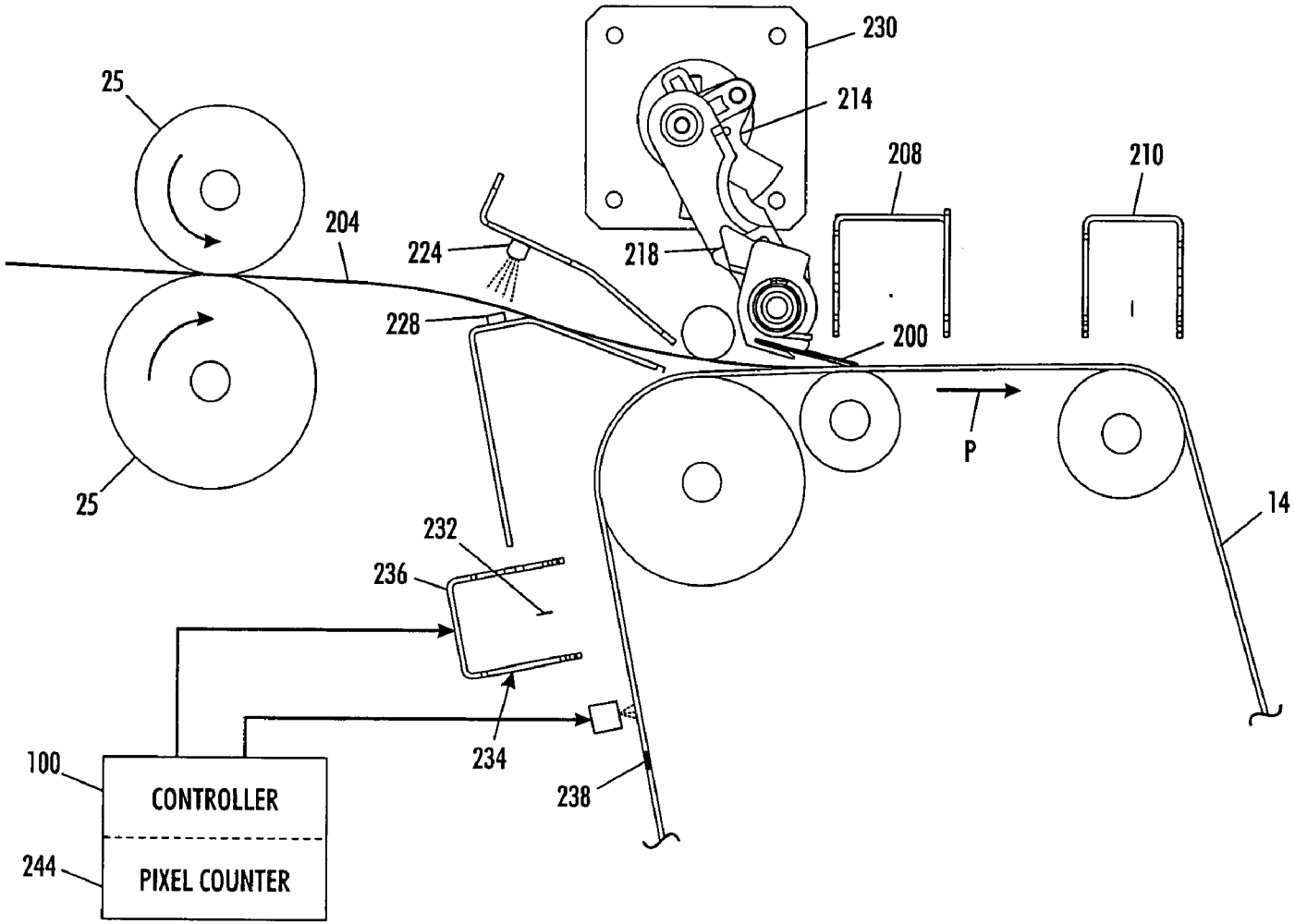
FIG. 2 is a schematic elevational view of a transfer station of the electrostatographic machine of FIG. 1.

Referring to FIG. 2, there is shown a magnified view of the transfer station 30 of an electrostatographic imaging device. A transfer assist blade ("TAB") 200 is shown engaged with the back of copy substrate 204, thereby pressing copy substrate 204 onto an image bearing member, such as photoreceptor belt ("PR") 14, as the copy substrate is driven in the direction of arrow P by pinch rollers 25. As noted above, many varieties of TAB systems are possible, and this embodiment is exemplary only. Corotron 208 charges copy substrate sufficiently to urge toner particles to transfer from PR 14 to copy substrate 204. Upon exiting the transfer section, corotron 210 provides an opposite charge, thereby aiding the detacking of copy substrate 204 from PR 14. In a typical embodiment, activation and deactivation of TAB 200 is induced by rotation of cam 214 which acts upon lever 218. TAB 200 is attached to the other end of lever 218. A controller 100 cooperates with a leading and trailing edge sensor system comprised of light emitter 224 and sensor array 228. In particular, the controller 100 determines the timing for activating a stepper motor 230 that controls the rotation of cam 214 in order that TAB 200 may be in contact with the back of copy substrate 204 as near as possible to both the leading and the trailing edges of the substrate.

As mentioned above, when the image to be reproduced is to the lead edge (LE) of the imaged area on the photoreceptor, there may be a loss of electrostatic toner tack force between the imaged area of the photoreceptor and the LE region of the substrate. As a result, drag force on the image substrate caused by pressing the TAB onto the substrate may be greater than tack force between the substrate and the photoreceptor, which, in turn, generates a velocity mismatch between the copy sheet and the photoreceptor, manifesting itself as a smeared image on or near the LE region of the substrate. The LE region may be assigned a predetermined distance from the leading edge of the substrate in accordance with typical image transfer protocols. For instance, in one embodiment, the LE region may be from 0 to about 5.0 mm from the leading edge of the substrate based upon the assumption that most copying or printing does not occur in that region of the substrate.

LE smearing may be reduced by increasing a tacking force that tacks the toner of the developed toner image to the photoreceptor at the lead edge region of the developed toner image. In one embodiment, the tacking force may be increased by applying a charge to the lead edge of the developed toner image. Referring again to FIG. 2, there is shown an apparatus for reducing leading edge (LE) smear in an electrostatographic machine comprising a pretransfer corotron 234 for applying a charge to the lead edge of the developed toner image prior to transfer. The pretransfer corotron 234 includes a generally U-shaped shield 236 partially surrounding an elongated electrode wire 232 that is connected to a power supply (not shown). The pretransfer corotron 234 is disposed traversely to the photoconductive belt 14 in the electrostatic imaging device at a position between the developing station 28 and the transfer station 30 to expose the photoconductive belt 14 to a corona discharge across its width. The pretransfer corotron 234 is configured to generate ions having the same polarity as the toner particles, thereby electrostatically increasing the adhesion of the toner particles to the photoreceptive member 14.

The pretransfer corotron 234 may be controlled by controller 100 which may be configured to control the corona discharge of the corotron in a known manner, such as by controlling the corotron (or coronode) current to the corotron. A memory is provided to store data necessary for the controller 100 to implement the corotron control protocols. In one embodiment, the bias applied to the corotron to produce the LE tacking force comprises a fixed pre-determined value. The predetermined bias or charge may be pre-programmed or set into the controller during manufacturing, input through the user interface or supplied over a network. The predetermined charge is calculated to increase the tacking force that tacks the toner of the developed toner image to the photoreceptor in order to overcome or compensate for the drag force that may be introduced by the application of the transfer assist blade to the substrate. The magnitude of the bias or charge applied to the lead edge is generally greater than that applied to the rest of the imaged area and may be approximately 1600V. Although, the actual current and voltage ranges, polarities, and nominal settings may depend on the specific system components, photoreceptors, imaging materials, copy members, etc.

In one embodiment, the timing sequence for activation of the pretransfer corotron 234 to treat the toner in the LE region involves cooperation between controller 100 and a location indicator 238 associated with the photoreceptor belt 14. In this timing sequence, a synchronizing sensor 240 detects when a location indicator 238 on the belt 14 passes the sensor location and relays a synchronization signal to controller 100. The location indicator 238 may be a hole in the PR 14. Since the rate of rotation or travel of PR 14 in the direction P is known, controller 100 is able to determine when the beginning of the LE region of the image bearing surface of the photoreceptor is in an operative position beneath the pretransfer corotron 234. The controller may then activate the pretransfer corotron for a predetermined duration that corresponds to the time that it takes for the LE region to pass beneath the corotron 234. Thus, the controller is configured to coordinate the activation and deactivation of the pretransfer corotron 234 in order to apply the predetermined charge to the LE region of the imaged area of the photoreceptor. Although the use of a location indicator 238 on the photoreceptor has been described, any suitable method for detecting the LE region may be implemented.

By increasing the tacking force at the lead edge to overcome the drag force of the TAB, LE smearing is less likely to occur because the toner particles at the lead edge adhere more strongly to the photoreceptor. The drag force caused by the TAB engaging the substrate may then be less likely to overcome the increased LE tacking force. Because increasing the tacking force may result in a slight loss of transfer efficiency resulting in a "lighter" or "hazier" image, the tacking force should only be increased at the lead edge where it is necessary to reduce LE smearing. Therefore, the image may only be lightened at the lead edge and not for the remainder of the image. Pretransfer switching need only be enabled, or "switched on", when LE smearing is detected during imaging operations. Thus, in one embodiment, the pretransfer switching system may be configured to be enabled or disabled in response to user input. For example, pretransfer switching may be included as an item that may be selectively controlled through the user interface. Thus, if an operator notices LE smear occurring during printing operations, pretransfer switching may be enabled manually such as, for example, by activating pretransfer switching through the user interface. For instance, a button may be provided on the interface that allows the selection of, for example, pretransfer toner treatment, LE smear reduction, etc.

In another embodiment, pretransfer toner treatment may be an automated function of imaging device 10 by determining the solid area coverage (SAC) in the leading region of the substrate after transfer to determine if LE smearing is occurring. The SAC may be determined in any acceptable manner that is capable of ascribing a quantitative value to the SAC for the leading region. For instance, in one embodiment, a pixel counter 244 of the controller 100 can provide information regarding the pixel count at each scanned line in the LE region. Since each pixel corresponds to an area of the substrate which will receive toner or other image transfer marking material, a count of the pixels in the leading region is representative of the solid area coverage. Various techniques may be employed to evaluate the pixel count, and ultimately the SAC, in the leading region. For instance, every image pixel may be counted and compared to a known value for the total number of pixels available in the leading region to produce an SAC ratio. Alternatively, only pixels in certain areas or in a certain pattern within the LE region may be evaluated to minimize the number of pixels that must be examined. As a further alternative, a random sampling pattern may be employed to provide a snapshot of the solid area coverage for the LE region.

Regardless of the smear detection approach, an SAC value is generated that is indicative of the image area transferred to the LE region. Armed with a solid area coverage value, the controller 100 is able to determine whether LE smear is occurring and whether pretransfer toner treatment is required to reduce the smearing. In one embodiment, the system controller may make a determination whether LE smearing is occurring by comparing the SAC value, or pixel count, of the LE region to a threshold coverage area value. This threshold value may be pre-defined to correspond to a certain coverage value that has been determined to indicate smearing. In this embodiment, the controller 100 receives the image pixel information produced in the pixel counter 244. A memory is provided to store data necessary for the controller such as, for example, lead edge SAC threshold values, corotron control protocols, etc.

Figure 3:
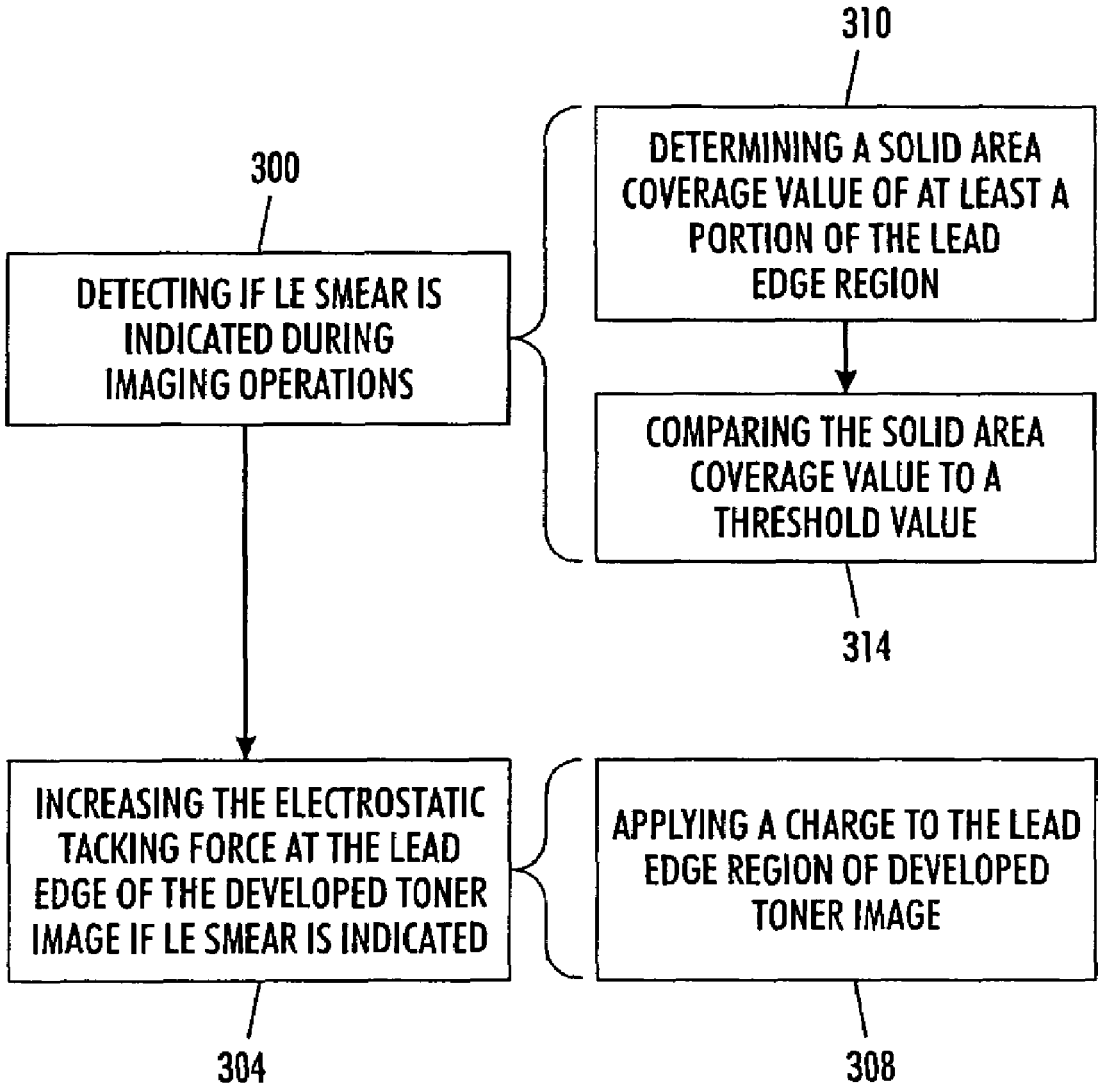
FIG. 3 is a flowchart of an exemplary method for reducing leading edge smearing in the electrostatographic machine of FIG. 1.

FIG. 3 shows a flowchart of a method for reducing LE smear in an electrostatographic imaging device is provided. The method comprises detecting if LE smear is indicated during imaging operations (block 300). If LE smear is indicated, tacking force for tacking toner of a developed toner image to a photoreceptive member is increased at approximately the lead edge region of the developed toner image on the photoreceptive surface prior to transfer (block 304). The tacking force may be increased by applying a charge to the lead edge region of developed toner image prior to transfer by using pretransfer corotron (block 308). This increased tack level charge or current may be a fixed pre-determined level selected and pre-programmed into the memory of the controller during manufacturing. Alternatively, the charge may at first be a minimum value that may be incrementally increased based continuous monitoring of the SAC in the LE region, thus assuring that the minimum required charge to reduce LE smearing is utilized.

Detecting if LE smear is indicated may comprise determining a solid area coverage value (SAC) of at least a portion of the lead edge region (block 310). Once the SAC is determined, the SAC is compared to a threshold value (block 314). This threshold value may be pre-defined to correspond to a certain coverage value that has been determined to indicate smearing. If the SAC determined is less than the threshold value, then LE smearing is not indicated and pretransfer toner treatment is not required. If the SAC is found to be approximately greater than or equal to the threshold value then LE smearing is indicated and pretransfer toner treatment is necessary.

While various exemplary embodiments have been described and illustrated, it is to be understood that many alternatives, modifications and variations would be apparent to those skilled in the art. Accordingly, Applicants intend to embrace all such alternatives, modifications and variations that follow in the spirit and scope of this disclosure.

What is claimed is:

1. A system for reducing lead edge (LE) smearing in an electrostatographic machine, the system comprising:

a pretransfer corotron positioned between a developing station and a transfer station in a electrostatographic imaging device, the pretransfer corotron for applying a predetermined charge to at least a portion of a developed toner image on a photoreceptive surface, the predetermined charge being greater than a charge applied to the rest of the developed toner image; and a controller operably associated with said pretransfer corotron, said controller for activating said pretransfer corotron to apply said predetermined charge to the developed toner image at a lead edge region of the developed toner image.

2. The system of claim 1, further comprising a transfer assist mechanism for providing substantially uniform contact between the image substrate and the photoreceptive member.

3. The system of claim 1, wherein the controller is configured to determine a solid area coverage value of the lead edge region of the developed toner image, and compare the solid area coverage value to a threshold value, the threshold value being pre-selected to indicate LE smearing; and wherein the controller is configured to activate the pretransfer corotron to apply the predetermined charge to the lead edge region of the developed toner image when the solid area coverage value is approximately equal to or greater than the threshold value.

4. The system of claim 3, wherein the controller includes a pixel counter for counting pixels in the lead edge region; and wherein the solid area coverage value corresponds to the pixel count of the lead edge region.

5. The system of claim 1, wherein the lead edge region is a predetermined distance from the leading edge.

6. The system of claim 5, wherein the predetermined distance is approximately 5.0 mm.

7. The system of claim 1, further comprising a sensor for detecting a location indicator on a photoreceptive surface and for generating a synchronization signal; and wherein the controller is configured to activate the pretransfer corotron to apply the predetermined charge to the lead edge region of the developed toner image on the photoreceptive surface based on the synchronization signal.

8. A method for reducing leading edge (LE) smear in an electrostatographic imaging device, the method comprising:

detecting if LE smear is indicated during imaging operations of an electrostatographic imaging device;

if LE smear is detected, increasing a tacking force for tacking toner of a developed toner image to a photoreceptive member at approximately a lead edge region of a developed toner image on a photoreceptive surface prior to transfer.

9. The method of claim 8, wherein increasing the tacking force comprises applying a charge to the lead edge region of developed toner image.

10. The method of claim 9, wherein the charge is applied by a pretransfer corotron.

11. The method of claim 8, wherein detecting LE smear comprises:

determining a solid area coverage value of at least a portion of the lead edge region;

comparing the solid area coverage value to a threshold value, the threshold value being pre-selected to indicate LE smearing; and increasing the electrostatic tacking force at the lead edge of the developed toner image when said solid area coverage value is approximately equal to or greater than the threshold value.

12. The method of claim 11, wherein the solid area coverage value comprises a count of the active pixels in the lead edge region.

13. The method of claim 8, wherein the lead edge region is a predetermined distance from the leading edge.

14. The method of claim 13, wherein the predetermined distance is approximately 5.0 mm.

15. An electrostatographic machine comprising:

a circulating photoreceptive member;

a charging station for uniformly charging the photoreceptive member;

an imaging station for selectively discharging the photoreceptive member to form latent images thereon;

a developing station for depositing toner on the latent images;

a transfer station for transferring the developed toner image from the photoreceptive member to an image substrate;

a pretransfer corotron for applying a predetermined charge to at least a lead edge region of a developed toner image on the photoreceptive member, the predetermined charge being greater than a charge applied to a remainder of the developed toner image; and a system controller operably associated with the pretransfer corotron, said system controller for activating the pretransfer corotron to apply the predetermined charge to the lead edge region of the developed toner image when lead edge smearing is detected during imaging operations.

16. The electrostatographic machine of claim 15, wherein the transfer station includes a transfer assist member for providing substantially uniform contact between the image substrate and the photoreceptive member.

17. The electrostatographic machine of claim 15, wherein the system controller is configured to determine a solid area coverage value for the lead edge region of the developed toner image; and wherein the system controller is configured to activate the pretransfer corotron when the solid area coverage value is approximately greater than a threshold value, the threshold value being pre-assigned to indicate leading edge smearing.

18. The electrostatographic machine of claim 17, wherein the system controller includes a pixel counter for counting pixels in the lead edge region of the developed toner image; and wherein the solid area coverage value corresponds to a pixel count of the lead edge region.

19. The electrostatographic machine of claim 15, wherein the controller is configured to activate the pretransfer corotron to apply the predetermined charge to the lead edge region in response to actuation of a switch accessible to a user of the electrostatographic device.

20. The electrostatographic machine of claim 15, the lead edge region is approximately 5.0 mm from the leading edge.

* * * * *